US007597221B2

(12) United States Patent
Lee

(10) Patent No.: US 7,597,221 B2
(45) Date of Patent: Oct. 6, 2009

(54) ELONGATED STOPPER DEVICE

(75) Inventor: Stephen Lee, Cardross (GB)

(73) Assignee: Refractory Intellectual Property GmbH & Co. KG, Vienna (AT)

( * ) Notice: Subject to any disclaimer, the term of this patent is extended or adjusted under 35 U.S.C. 154(b) by 405 days.

(21) Appl. No.: 11/570,738

(22) PCT Filed: Jun. 23, 2005

(86) PCT No.: PCT/EP2005/006784

§ 371 (c)(1),
(2), (4) Date: Dec. 15, 2006

(87) PCT Pub. No.: WO2006/007933

PCT Pub. Date: Jan. 26, 2006

(65) Prior Publication Data

US 2008/0042094 A1 Feb. 21, 2008

(30) Foreign Application Priority Data

Jul. 22, 2004 (EP) ..... 04017318

(51) Int. Cl.
*B22D 41/18* (2006.01)

(52) U.S. Cl. ..... 222/597; 251/339; 277/610

(58) Field of Classification Search ..... 251/339; 222/591, 597, 600, 601, 602; 277/610
See application file for complete search history.

(56) References Cited

U.S. PATENT DOCUMENTS

| | | | | | |
|---|---|---|---|---|---|
| 26,510 | A | * | 12/1859 | Miller et al. | 277/610 |
| 196,398 | A | * | 10/1877 | Stoy | 277/610 |
| 4,836,508 | A | * | 6/1989 | Fishler | 222/603 |
| 5,024,422 | A | * | 6/1991 | Fishler et al. | 222/597 |
| 5,303,905 | A | * | 4/1994 | Pohl et al. | 222/602 |
| 5,997,007 | A | * | 12/1999 | Hanashima et al. | 277/610 |
| 6,026,997 | A | * | 2/2000 | Kremer et al. | 222/602 |
| 6,367,671 | B1 | * | 4/2002 | Hanse et al. | 222/597 |

FOREIGN PATENT DOCUMENTS

| | | |
|---|---|---|
| DE | 40 40 189 C1 | 1/1992 |
| EP | 0 358 535 B2 | 5/2000 |
| EP | 1 106 284 A1 | 6/2001 |
| EP | 1 135 227 B1 | 10/2002 |
| GB | 2 247 637 A | 3/1992 |
| WO | 00/74880 A1 | 12/2000 |

* cited by examiner

*Primary Examiner*—John Bastianelli
(74) *Attorney, Agent, or Firm*—Christopher L. Parmelee; Walker & Jocke

(57) ABSTRACT

An enlongated stopper device for flow-control of molten metal from a vessel, containing molten metal, said device comprising: a) a body (10) made of a refractory ceramic material, b) a bore hole (12), having a longitudinal axis (A) and extending from an upper surface (10*u*) of said body downwardly, c) a rod (14), penetrating with one end (14*l*) into said bore hole (12) and being fixedly secured within said body (10), d) a sealing member (18), being arranged within a space adjacent to or being part of said bore hole (12), said space being defined at least partly by unlike surface sections (12*a*, 12*i*, 14*s*) of said rod (14) and said body (10) respectively.

11 Claims, 2 Drawing Sheets

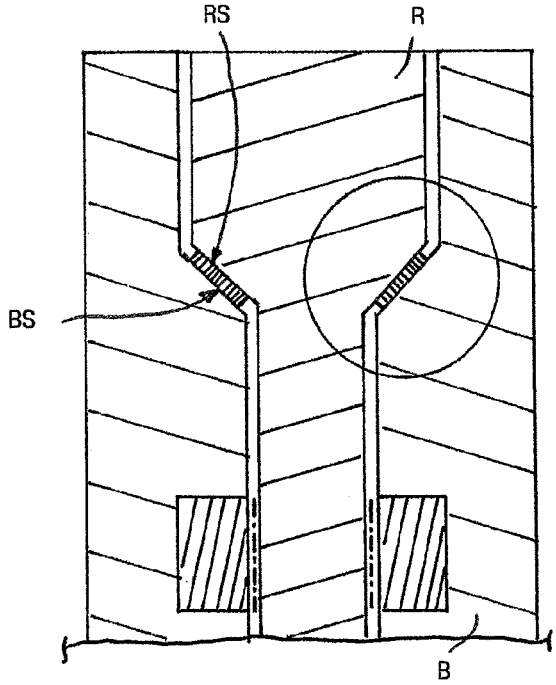
FIG.1
Prior Art
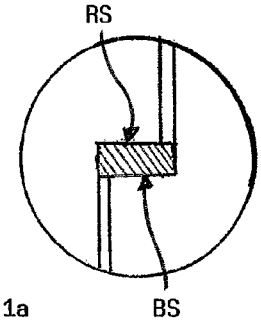
Fig. 1a
Prior Art
FIG. 2
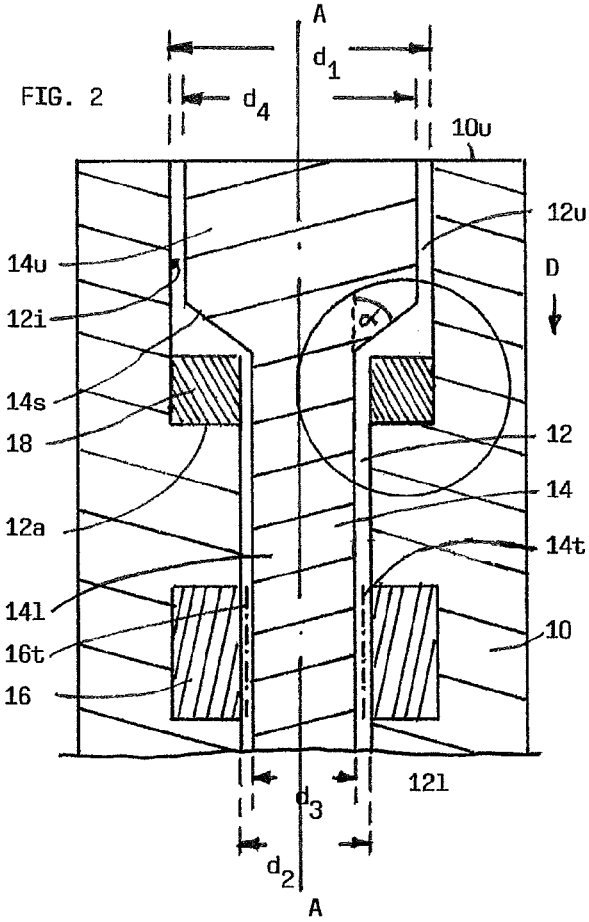
Fig.2a
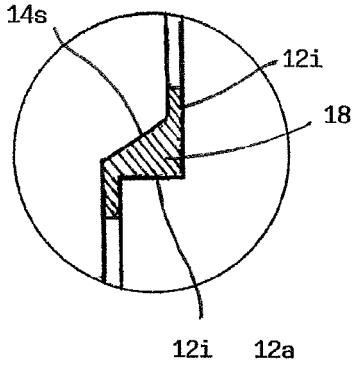
Fig.2b
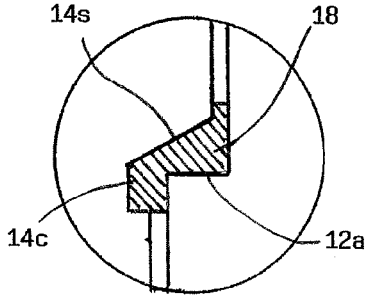

ELONGATED STOPPER DEVICE

FIELD OF THE INVENTION

The invention relates to an elongated stopper device for flow control of molten metal, i.e. for controlling the flow of molten metal from a metallurgical vessel, such as a tundish.

BACKGROUND OF THE INVENTION

It is well known in steel casting to employ a one-piece refractory stopper rod, which is moved vertically by the use of a lifting mechanism in order to vary the cross-sectional area of an outlet opening of the corresponding metallurgical vessel.

Those stopper rods have also been used to introduce an inert gas, such as argon, into the molten steel for removing non-metallic inclusions from the molten metal.

In all cases the stopper device must withstand hours submerged in molten metal. It must also be capable of enduring the harsh thermal shock encountered on the start-up of casting and any mechanical forces imposed to it.

Insofar many attempts have been made to improve the mechanical and thermal properties of such a stopper device and to improve its behaviour during use.

EP 0 358 535 B2 discloses a one-piece refractory stopper rod adapted to a lifting mechanism, comprising an elongated stopper rod body of a refractory material, which body being provided with a bore hole, having a longitudinal axis and extending from an upper surface of said body downwardly. Within said axial bore hole a metal bushing is inserted to threadably receive a threaded part of a metal rod, inserted in said refractory body for attachment to a corresponding lifting mechanism.

In a stopper rod for introducing gas into the melt it is important to provide a sealing between the refractory body and the metallic rod in order to prevent substantial loss of said gas and the infiltration of air.

To improve the required tightness it was proposed to place an annular gas tight gasket between the corresponding sealing surfaces. According to EP 1 135 227 B1 the axial bore hole of the body has an enlarged part that presents an annular sealing surface spaced away from the upper end of the body. A ring shaped graphite gasket is placed on said annular sealing surface and cooperates with a collar located on the rod.

This stopper design generates the seal in an axial manner, between like surfaces, with associated service risks of disruption of the seal by an increased expansion effects of the metallic rod compared to the surrounding ceramic body.

The same is true with a stopper design according to EP 0 358 535 B2.

SUMMARY OF THE INVENTION

It is therefore an object of the present invention to provide an elongated stopper device for flow control of a molten metal from a vessel, containing molten metal, which is easy to produce and provides effective sealing means.

It has now been found that the disadvantages described mostly result, when the sealing means is more or less exclusively compressed between like surfaces by unidirectional axial forces. This is shown in FIG. 1, demonstrating prior art accordingly to EP 0 358 535 B2 (FIG. 2). Like (parallel) sealing surfaces BS of refractory body B and RS of rod R may only cause unidirectional compression upon insertion of rod R into body B. The same is true when said surfaces BS and RS are arranged as shown in FIG. 1*a*.

Contrary to the known sealing technique it has been discovered that the desired tightness may be improved characteristically when the sealing member is compressed by forces effective in different directions, for example by introduction of a radial force additionally to any axial forces. The more the sealing material is compressed by radial forces the more effective is the sealing. The sealing and corresponding tightness may be achieved during a complete working period of the stopper device, i.e. at ambient temperature, during heat up, at maximum working temperature and during cooling down.

Thus the sealing member may be contained within a space defined between unlike surfaces. These unlike surfaces may be surfaces provided by an outer surface of said steel rod and an inner surface section of the said stopper body. The shape and size of the space defined by these sealing surfaces is changed during the assembly process, for example during insertion of a metal rod into a bore hole of the stopper body, thereby exerting a combination of radial and axial forces which cause the sealing member to be compressed and deformed to take up a new shape dependant on the final positions of the sealing surfaces with respect to each other.

It derives from the coaxial arrangement of the metallic rod within the bore hole that the sealing member should be arranged more or less coaxially and radially with respect to the rod.

The sealing member may be loosely positioned in this position during the assembly process or co-pressed within the ceramic body during the forming process in a manner known in the art so as to become an integral element within the structure of the ceramic stopper body.

It is clear that the sealing element must exhibit the ability to deform at ambient temperature to create a gas tight seal during assembly. At the same time the seal element must withstand those temperatures present when the stopper device is in use. While it should maintain its new form after assembly the sealing element should have the ability for further deformation at higher temperatures, reached in use.

While the sealing member may initially have a ring like shape with curved or parallel flat upper and/or lower surfaces it will achieve any different shape after compression, depending on the respective positions of the surfaces, pressed against it.

In its most general embodiment the invention relates to an elongated stopper device for flow control of molten metal from a vessel, containing molten metal, wherein said device comprises:

- a body made of a refractory ceramic material,
- a bore hole, having a longitudinal axis and extending from an upper surface of said body downwardly,
- a rod, penetrating with one end into said bore hole and being fixedly secured within said body,
- a sealing member, being arranged within a space adjacent to or being part of said bore hole, said space being defined at least partly by unlike surface sections of said rod and said body respectively.

The sealing member is deformed during assembly, when said metal rod is inserted into the bore hole of the refractory body. The seal element thereby is changed to a new configuration, i.e. its outer shape changes.

In prior art devices (FIG. 1 of EP 1 135 227 B1) the seal element is shown to be only compressed axially during assembly by like surfaces whereby the cross-sectional area of the seal element may be diminished, but its generally rectangular cross-section is maintained. Contrary to this the new stopper device provides a space for said sealing element, said space being defined by unlike sealing surface profiles (sealing surfaces) so that the sealing element is subjected to both axial and radial compression forces which lead to a deformation of the cross-sectional area (and change of the outer shape) of the sealing element. At the same time as the space into which the sealing element had been placed, becomes smaller, the sealing material will be deformed and penetrates into any adjacent spaces, like any space between the bore hole of the ceramic body and the main portion of the metal rod. This will be described in further detail according to the attached figures.

Even during service the new design develops further advantages. During service (under high temperature load) differential expansion arising from the increased temperature results in a more radial expansion of the metallic support rod than of the ceramic body surrounding it and therefore in an increase in the seal efficiency by further compression of the sealing element in radial direction.

Insofar as reference is made to unlike sealing surface profiles those refer to opposite surfaces which are not running parallel to each other.

According to one embodiment at least one of these surface sections (sealing surface profiles) defining the space for said sealing member, extends at least partially perpendicular to the longitudinal axis of said bore hole.

During service, when the stopper device is fixed to a corresponding lifting mechanism and extends vertically, this surface section is arranged horizontally. This horizontal part may be provided by an enlarged bore hole section. The said horizontally oriented surface section equals the annular sealing surface 10 according to FIG. 1 of EP 1 135 227 B1. Even the adjacent vertical wall section of the corresponding bore hole equals said prior art construction. The decisive difference now is that at least one of the other (opposing) sealing surfaces allows multidirectional compression of the sealing member. Therefore said additional sealing surface is oriented at an angle >0 and <90° with respect to the longitudinal axis of the bore hole. This may simply be achieved by providing a corresponding bevelled surface section of the rod which will be further described according to the attached drawings.

A similar multidirectional compression will arise if the corresponding sealing surface of the steel rod has a radiussed profile rather than an angled form.

The afore described design provides an enlarged bore hole section in the upper part of the body. While the rod may correspondingly be provided with sections of different diameter another embodiment suggests to arrange a sleeve in said enlarged bore hole section. In this embodiment the sleeve fills the cylindrical space between the rod and the enlarged bore hole section. At the same time the sleeve provides one of the surfaces defining the chamber comprising the sealing element (gasket). Therefore the corresponding sealing surface of said sleeve may have an orientation with respect to the longitudinal axis of the bore hole which is unlike to at least one of the surface sections further defining the chamber into which the sealing member is contained.

The cross-sectional area of said space may have any shape as long as there is at least one surface section allowing compression of the sealing element by multidirectional forces. Therefore at least one surface section of the bore hole or the rod respectively defining the said space may provide an angle >0 and <90° with respect to the longitudinal axis or said surface section may provide an appropriate curved surface.

A triangular or pentagonal cross-sectional area are two of many possibilities.

Typically an asymmetrical cross-sectional area will be provided.

As will be described with reference to the attached drawings the rod may have a smaller width at its part adjacent to said space then at its part on top.

The said part with smaller width may extend below said space.

The sealing member may be made of graphite.

A useful sealing member, fulfilling the above mentioned requirements, is made of a compressed graphite material with a purity >95 weight-% carbon and a density of about 1.4 g/cm$^3$.

It is convenient to use a ring-shaped sealing gasket.

The sealing member may be made of a wound up tape (a coil of graphite foil). Windings of said sealing member should then extend in the longitudinal direction of the bore hole or the rod respectively. Alternatively it may also be useful to use a sealing member made of a number of sheet-like rings, one placed on top of the other and bound together.

Said graphite sealing member (gasket) may be used at service temperatures of typically 800-1.200° Celsius without problems. There is no change in rigidity or sintering at these temperatures with such graphite gaskets. On the other hand even at these temperatures the sealing member retains the ability for further deformation to both enhance the efficiency of the sealing mechanism and absorb mechanical stresses which could otherwise result in mechanical damage during service.

The compressed sealing member exhibits these desired properties. The absence of a supply of oxygen within the assembly and the inert atmosphere provided by gas injection through an axial bore of said rod and/or the bore hole of the ceramic body prevent any degradation by oxidation during service.

The most important feature of the invention is that the sealing member is deformed into a completely new configuration when the rod is inserted into the ceramic body as described before. It establishes the required circumferential joint profile filling the space between the exterior of the metallic rod and the corresponding wall of the bore hole of the ceramic stopper body.

The sealing member may be arranged above or below additional fixing means, which may be designed as a bushing with a threaded bore, cooperating with an outer thread of the rod.

Said fixing means may be made of any material, different from the material of the refractory body and strong enough to receive and fasten the corresponding metal rod. For example the fixing means may be made of metal or special ceramics like silicon nitride, zirconia or alumina.

Insofar as in this description reference is made to "above", "upper", "lower", "downwardly", etc it is referred to the typical use of such stopper rod, running predominantly vertical.

It seems clear from the description above that if said stopper device is used for introducing gas the corresponding rod will be equipped with an axial bore through which the gas is fed. The corresponding bore hole of the body will then be provided with at least one opening at its lower end.

Further details of the invention will be described in the subclaims and the other application papers.

The invention will now be described with respect to one embodiment which in no way limits the scope of the claimed stopper device.

BRIEF DESCRIPTION OF THE DRAWINGS

FIGS. 1 and 1*a* show examples of stopper devices.

FIGS. 2, 2*a*, and 2*b* schematically show an upper part of a stopper device in a partly longitudinal cross sectional view.

DETAILED DESCRIPTION OF THE INVENTION

Figure 3:
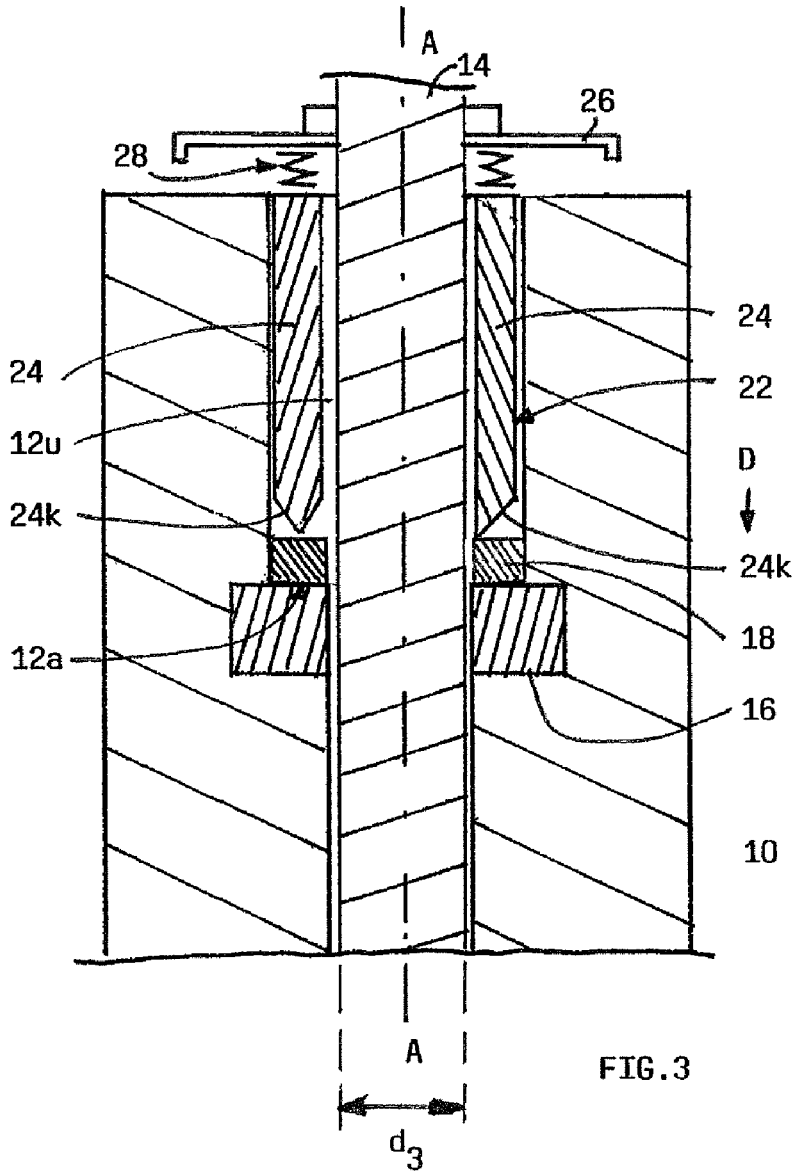
FIG. 3 shows another embodiment of a stopper device.

The stopper device comprises an elongated refractory body 10 with a central bore hole 12, positioned coaxially with respect to body 10 and adapted to fixedly receive a metal rod 14 for its attachment to a (non-shown) lifting mechanism.

The bore hole 12 is of more or less cylindrical shape. It has an upper part 12*u*, characterised by a diameter $d_1$ and a lower part 12*l* characterised by a smaller diameter $d_2$.

A transition section between upper part 12*u* and lower part 12*l* is provided by an annular surface 12*a*, onto which a ring-shaped graphite gasket 18 is placed. This gasket 18 is made of a graphite foil, coiled up to said ring-shape shown in FIG. 2.

Below said gasket 18 a ceramic thread 16 with an inner thread 16*t* is arranged within the ceramic refractory material of body 10 as to threadably receive a corresponding outer thread 14*t* of rod 14.

Rod 14 is designed as follows: Its lower part 14*l*, provided with said outer thread 14*t*, has a diameter $d_3$, slightly smaller than $d_2$.

Upper part 14*u* of rod 14 has a diameter $d_4$, slightly smaller than $d_1$ but larger than $d_2$.

As may be seen from FIG. 2 the transition area between lower part 14*l* and upper part 14*u* is characterised by a sloping section 14*s*.

While annular surface 12*a* is arranged perpendicular to the longitudinal axis A of the bore hole 12 and the rod 14 respectively sloping sealing surface 14*s* provides an angle $\alpha$ of about 45° to said axis A.

During assembly, when said rod 14 is introduced (screwed) into said bore hole 12 sealing surface 14*s* compresses sealing member 18, which is urged under multidirectional forces, caused by inclined sealing surface 14*s* to vary its shape and to take up a new (different) compressed form, while at the same time flowing into adjacent voids (gaps) between rod 14 and bore hole 12. This may best be seen in FIG. 2*a*, which corresponds to the encircled portion of FIG. 2 after rod 14 had been further pushed into body 10 (in the direction of arrow D).

It becomes clear from FIG. 2*a* that an intimate sealing is provided between rod 14 and body 10, mainly caused by unalike (unlike) surface sections defining the space for taking up sealing member 18.

The circumferential element of the seal will be further compressed and the tightness improved in service by (further) radial and axial expansive forces resulting from the higher expansion coefficient of the steel support rod 14 compared to that of the refractory ceramic body 10 of the stopper device.

Again: The different profile 14*s*, next to sealing member 18, of rod 14, compared with corresponding surface sections 12*a* and inner wall 12*i* of bore hole 12 are responsible to provide a deforming means for the seal element 18 during the assembly process and in service.

The sealing effect may even be improved by an enlarged space into which the sealing material may be deformed. FIG. 2*b* shows a corresponding embodiment, whereby the profile of the metallic rod 14 includes an undercut 14*c* into which the graphite material is deformed by movement of rod 14, increasing the circumferential area and tightness of the seal.

FIG. 3 shows another embodiment of a stopper device. In this embodiment annular sealing surface 12*a* is provided by an upper surface of nut 16. Sealing member 18 is placed directly onto nut 16.

Rod 14 has a constant diameter $d_3$ along its part running within body 10, thus providing a cylindrical space 22 between rod 14 and upper part 12*u* of bore 12 with enlarged diameter $d_1$.

A sleeve 24 is inserted into said space 22. At its lower end sleeve 24 presents a knife-like profile 24*k*. It is to be understood that different profiles 24*k* on the left and on the right in FIG. 3 are showing two possible embodiments while in practice the sleeve is being provided with one profile only.

In order to lock the various components (body 10, rod 14, sleeve 24, gasket 18) a dished washer 26 is provided on upper surface 10*u* of body 10, while a spring disk 28 is arranged between washer 26 and sleeve 24 to press sleeve 24 downwardly (direction D) and into sealing means 18 in order to deform sealing means 18 and fill out any spaces (gaps) between rod 14 and inner wall 12*i* of bore hole 12.

The inventors have made tests to compare the effectiveness of the described new, gas purging stopper device and especially its tightness during use. The gas flow was 5 liters/min at an applied pressure of 3 bar.

It was shown that full and intensive tightness was achieved from the start-up time, during temperature increase (up to about 900° C., which is typical of those temperatures measured during service application) for at least 45 min as well as during subsequent cooling.

In a comparative test with a prior art device tightness was lost during heat up after 20 min, when no gasket was used.

In a stopper device according to prior art (with a gasket arranged within a space of rectangular cross-section) the seal tight got lost at temperatures above 800° C. and no sufficient tightness was observed during the subsequent cooling period.

The invention claimed is:

1. An elongated stopper device for flow-control of molten metal from a vessel, containing molten metal, said device comprising:

a) a body (10) made of a refractory ceramic material, b) a bore hole (12), having a longitudinal axis (A) and extending from an upper surface (10*u*) of said body downwardly, c) a rod (14), penetrating with one end (14*l*) into said bore hole (12) and being fixedly secured within said body (10), d) a sealing member (18), being arranged within a space adjacent to or being part of said bore hole (12), e) said space being defined at least partly by at least three unlike opposing surface sections (12*a*, 12*i*, 14*s*) of said body (10) and said rod (14) respectively, with at least one of said surface sections (14*s*) of the rod (14) or the body (10) respectively extending at an angle $\alpha>0$ and $<90°$ to the longitudinal axis (A) of said bore hole (12) or provides an appropriate curved surface, so that sealing member (18) varies its shape to fill the space when said rod (14) is introduced into said bore hole (12), while at the same time flowing into voids between said rod (14) and bore hole (12) adjacent to said space, f) said rod (14) has a smaller width at its part (14*s*, 14*l*) adjacent to said space than at its part on top (14*u*) and said part (14*l*) adjacent said space extends below said space, g) fixing means (16, 16*t*, 14*t*) are arranged below said sealing member to receive and fasten the rod (14) within the body (10).

2. Stopper device according to claim 1, wherein at least one of said surface sections (12*a*) extends at least partially perpendicular to the longitudinal axis (A) of said bore hole (12).

3. Stopper device according to claim 2, wherein said surface section (12*a*) extending perpendicular to the longitudinal axis (A) of said bore hole (12) being part of an enlarged bore hole section (12*u*).

4. Stopper device according to claim 1, wherein said space provides a triangular or pentagonal cross sectional area.

5. Stopper device according to claim 1, wherein said space provides an asymmetrical cross sectional area.

6. Stopper device according to claim 1, wherein said rod (14) has a beveled surface section.

7. Stopper device according to claim 1, wherein said rod (14) has a radiussed profile.

8. Stopper device according to claim 1, wherein said sealing member (18) is made of graphite.

9. Stopper device according to claim 1, wherein said sealing member (18) is ring shaped.

10. Stopper device according to claim 1, wherein said sealing member (18) is made of a wound up tape made as a coil of graphite foil, whereby windings of said sealing member (18) extend parallel to the longitudinal axis (A) of said bore hole (12).

11. Stopper device according to claim 10 where sealing member is co-formed into the ceramic body during the production process.

* * * * *